US006076719A

United States Patent [19]

Vozick

[11] Patent Number: 6,076,719

[45] Date of Patent: Jun. 20, 2000

[54] TRANSPORT SYSTEM FOR PROPELLING PHOTOGRAPHIC FILM THROUGH AN AUTOMATIC FILM PROCESSING MACHINE

[75] Inventor: David Vozick, Elmsford, N.Y.

[73] Assignee: AFP Imaging Corporation, Elmsford, N.Y.

[21] Appl. No.: 09/205,776

[22] Filed: Dec. 4, 1998

[51] Int. Cl.[7] ..... B65H 20/00; G03D 3/08

[52] U.S. Cl. ..... 226/181; 226/188; 226/194; 396/622

[58] Field of Search ..... 226/181, 188, 226/189, 194; 396/622

[56] References Cited

U.S. PATENT DOCUMENTS

| | | | |
|---|---|---|---|
| 3,297,223 | 1/1967 | Bueker | 226/194 X |
| 4,326,791 | 4/1982 | Beer et al. | 226/189 X |
| 4,358,194 | 11/1982 | Krehbiel | 226/189 X |
| 4,745,423 | 5/1988 | Uchida | 226/188 X |
| 5,108,878 | 4/1992 | Nakamura | 396/622 X |
| 5,347,337 | 9/1994 | Patton et al. | 396/622 |
| 5,785,312 | 7/1998 | Krupica et al. | 226/189 X |

*Primary Examiner*—Michael R. Mansen
*Attorney, Agent, or Firm*—Cooper & Dunham LLP

[57] ABSTRACT

A film transport device for an automatic film processor that sequentially transports film from a dry environment into and out of liquid solutions. The device includes a series of gear driven, opposed roller pairs which are pre-aligned and bearing mounted for easy removability and replacement. Power transmission is provided to the transport module from a motor driven, low torque gear shaft assembly, which is contained within the processor. The side plates of the transport assembly are divided into upper and lower plates to facilitate repair and cleaning.

9 Claims, 12 Drawing Sheets

TRANSPORT SYSTEM FOR PROPELLING PHOTOGRAPHIC FILM THROUGH AN AUTOMATIC FILM PROCESSING MACHINE

BACKGROUND

The present invention relates generally to a transport system for sequentially propelling photographic film through an automatic film processing machine.

In film processors for medical, graphic and photographic applications, there generally is a roller arrangement rack for moving the film through developer and fixer solutions.

As described in U.S. Pat. No. 3,656,676 (Hope), it is a practice in the industry to develop elongated film, such as 16millimeter, 35 millimeter, and 70 millimeter film, automatically by utilizing a plurality of side by side tanks and by employing film rack assemblies in conjunction with the processing tanks to direct the film through various stages of the development process.

In existing film processors, the rack assemblies utilize pairs of cooperating driven rollers to lead the film through the various development stages. Because of the length of the film, any small variation in the position of a roller will result in inconsistencies in processing over the length of film. This arrangement requires the total disassembly of the processor if an internal roller is out of position or malfunctions or needs cleaning. Total disassembly includes removing chain drivers, pulling gears off their roller shafts, and removing the entire side plates which hold the rollers. The procedure is time consuming and presents difficulties for the field service person.

Each film transport assembly has plastic hard rollers and rubber coated soft rollers to drive the film forward during the development process. In general, plastic is substantially cheaper than rubber by a factor of 10:1. However, the hard plastic rollers immerse in a fixer bath and electrostatic charges tend to electroplate silver onto the hard plastic rollers. This requires replacing the hard rollers to avoid artifacts forming on the outer circumference of the roller. Similarly, the rubber coated soft rollers grip the entry of the film into the transport and remove excess liquid on the surface of the film by squeezing the film at the exit. The rubber coated soft rollers swell in time from immersion into chemical processing liquids and require easy replacement. The wash transport and dryer transport are best suited for any squeezing action or vertical displacement of the film. A tangential force component is provided by the rubber to drive the film through the rollers. Therefore, pairs of scratch free and artifact free rollers are required to handle the x-ray film.

The gap between the rollers ranges from 0.002 to 0.010 inches depending on tolerances such as designed roller bearing centers, film thickness, gravity pressing the top roller on the film, and closing the gap to direct contact. Any excess pressure will mark and distort the soft gelatin emulsions in the developer solution. Normal x-ray film is 0.007 inches thick with emulsion on both sides.

Another problem associated with conventional roller transports, particularly a chain-driven roller transport, is inconsistencies in the final film product due to varying tension in the chain.

Another problem associated with conventional roller transports, particularly a belt driven roller transport, is that belt driven rollers transports are not equipped to handle single emulsion CRT recording film for medical use.

OBJECTS AND SUMMARY OF THE INVENTION

It is therefore an object of the present invention to provide an improved transport system for propelling a photographic film through an automatic film processor.

It is a further object of this invention to provide a film transport which is easily removable and replaceable.

It is also an object of the invention to provide an improved transport system including side plates for the rollers which may be readily removed.

It is also an object of the invention to provide an improved transport system including cooperating pairs of opposed rollers that are readily aligned and connected.

It is also an object of the invention to provide an improved transport system designed to automatically disengage from the power source and pop-up if transported film gets caught or jammed while being transported through the processor.

It is also an object of the invention to provide an improved transport system which requires a smaller powered motor.

The present invention contemplates a film transport rack assembly which provides for vertical displacement of the film into and out of liquid solutions as the film is propelled along its primary horizontal path. The film transport assembly is a removable subcomponent from the film processing machine.

Power transmission is provided to the transport module from a motor driven, gear shaft assembly, which is contained within the processor and has numerous integral, driving single-tooth worm gears. Each module contains two driven multi-tooth worm gears, which engage with the worms on the shaft for the purpose of receiving the transmitted torque, and providing the rotation to the gear train and rollers within the module for moving the film. The cooperating pairs of opposed rollers within the transport system direct the film through the system. The rollers are held in place by side plates which are split into upper and lower sections to allow ready removal of the rollers. Alignment bearing retainer links connect the side plates and rollers.

The rollers are driven through a gear train to propel the film at constant speed. Each roller is provided with a drive gear affixed to one end of the roller shaft. The pitch diameter of the gear is identical to the outer diameter of the roller thereby causing one revolution of the gear to be equal to one revolution of the roller, such that the film advances by approximately 3.14 times the diameter of the roller. The film travels only through the rollers of the transport system and is never exposed to equipment which may scratch or otherwise damage the film surface.

The entire film processing system requires four transports: one module each for the developer solution section, fixer solution section, wash water section and thermal dryer section. The actual configuration of each individual module will vary as a result of the required film transport path.

DETAILED DESCRIPTION OF PREFERRED EMBODIMENTS

Figure 1:
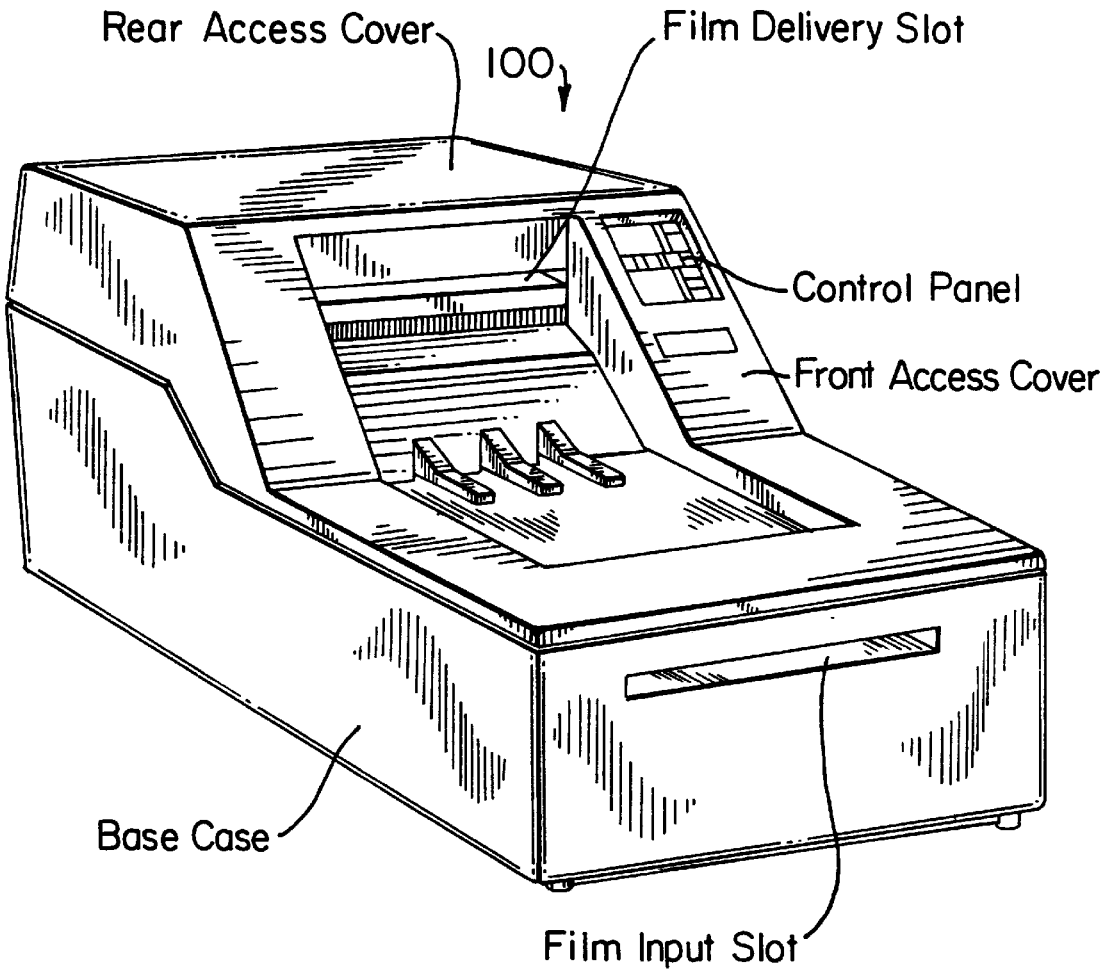
FIG. 1 is a perspective view of an existing model film processor.

Preferred embodiments of the present invention are described below with reference to the accompanying drawings, in which like reference numerals represent the same or similar elements.

Figure 2:
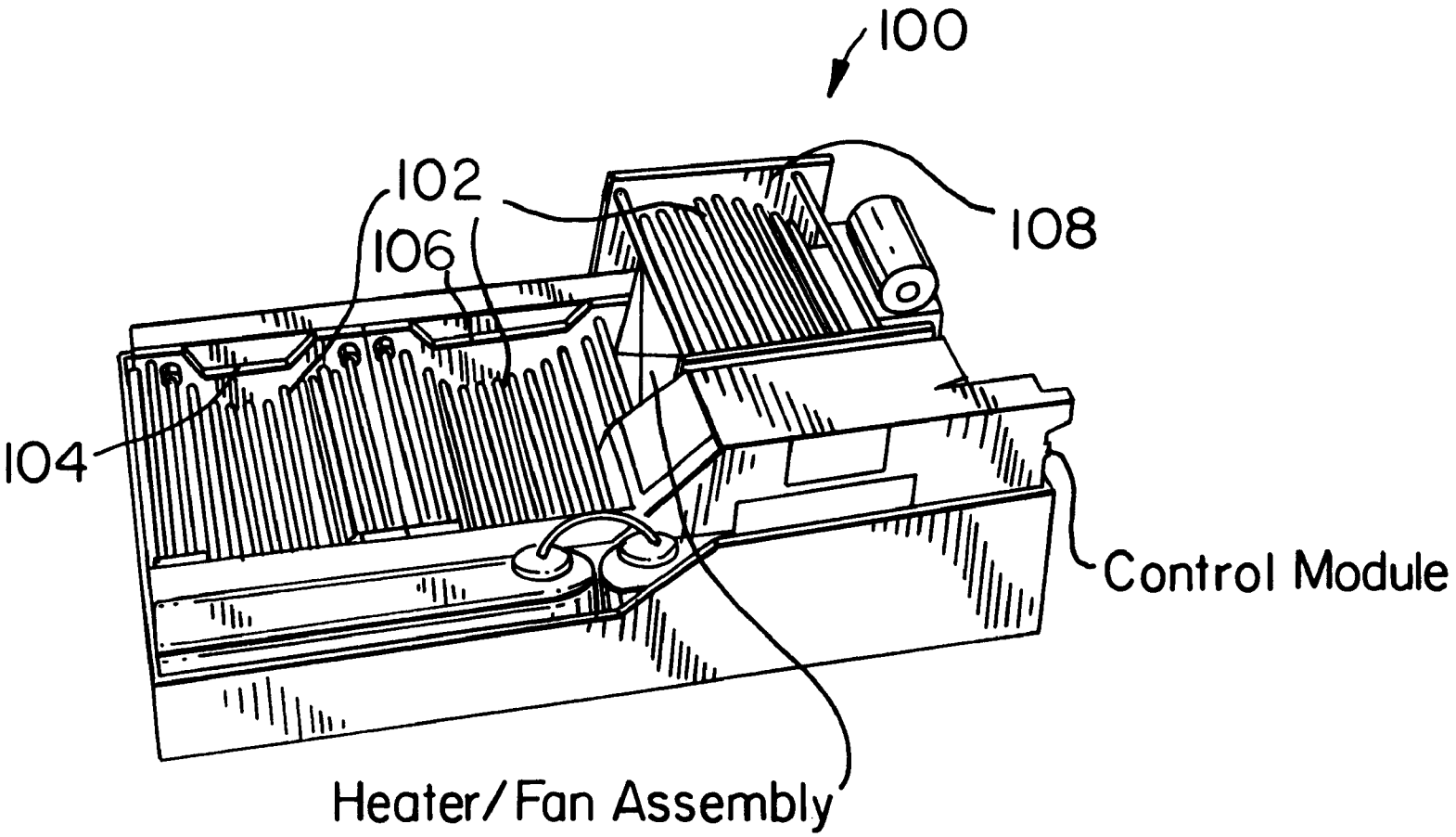
FIG. 2 is a perspective view of the fixer transport module and the developer transport module of another existing model film processor.
Figure 3:
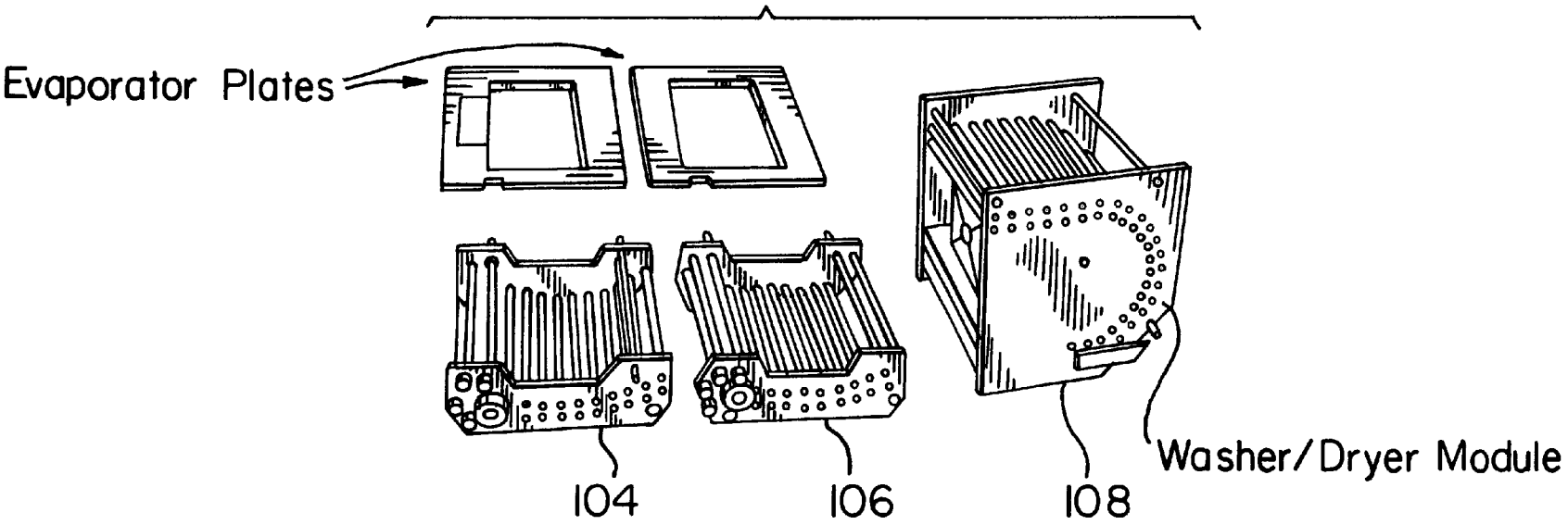
FIG. 3 is a view of developer and fixer transport modules of an existing model film processor.

Referring to FIGS. 1, 2 and 3, there is shown the major components of existing film processors 100 including the transport system. Roller pairs 102 are used to transport the film in a developer transport module 104, a fixer transport module 106 and a washer/dryer module 108.

Figure 4:
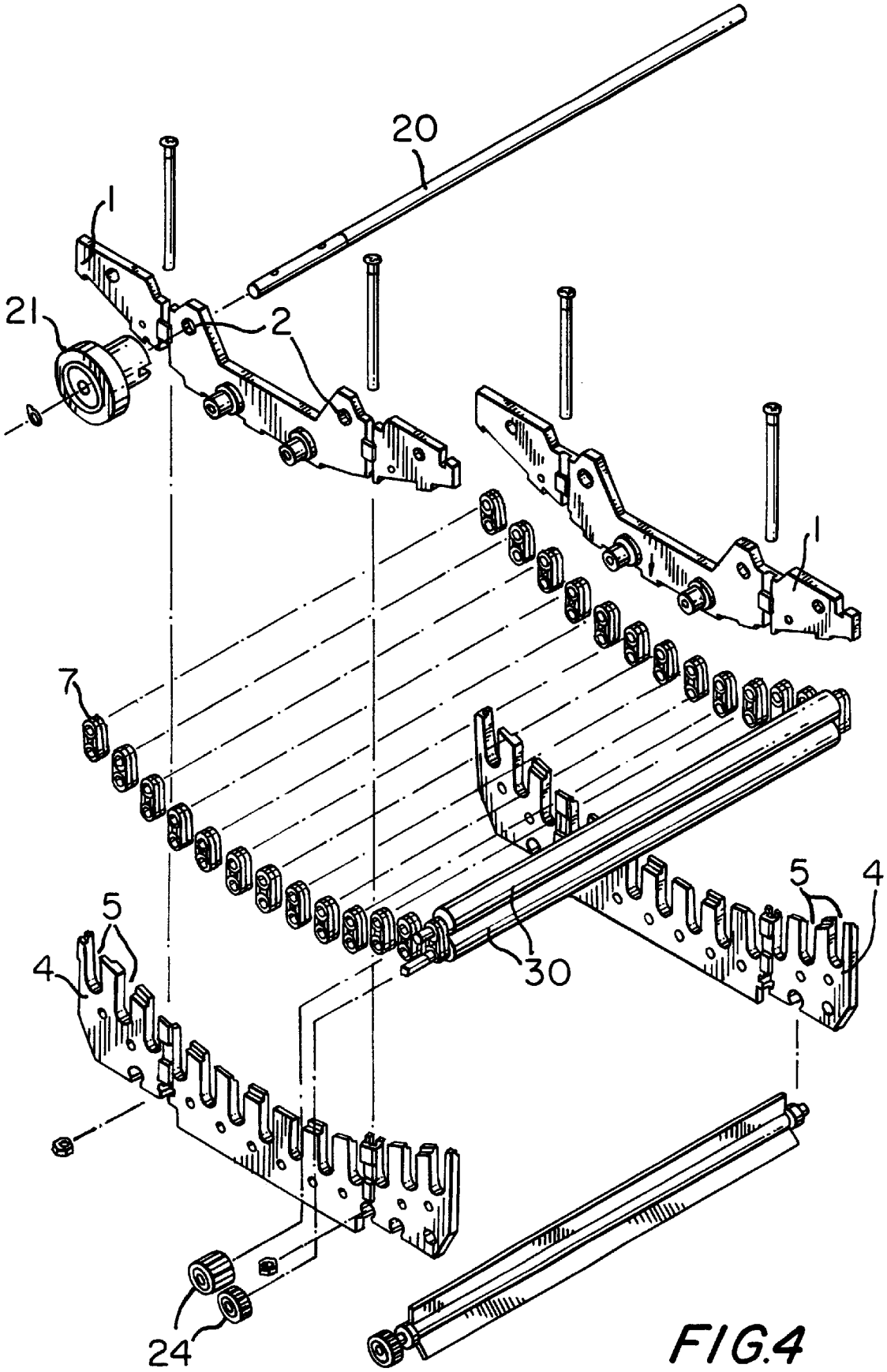
FIG. 4 is an exploded view of the transport system of the present invention.

An exploded view of the interior of a fixer transport module 106 is shown in FIG. 4. The fixer module is modified in accordance with the present invention.

The transport module includes a plurality of rollers 30 disposed between side plates to form roller pairs. Each side plate is formed of an upper side plate 1 and a lower side plate 4. The side plates are identical and inter-changeable. The upper side plate 1 contains two round aperture openings 2 on the top portion of the upper side plate for receiving an input drive shaft 20. Power transmission is provided to the input drive shaft 20 from a motor-driven gear train assembly 21, 24. The motor is not shown and may be of any suitable type. The gear train assembly 21, 24 rotates the opposed rollers 30 of the roller pair at a constant speed. The opposed rollers 30 are pre-aligned. At their ends, they are journalled in bearings, preferably alignment bearing links 7, which connect the ends of the opposed rollers 30 of a pair. The lower side plates 4 have slots 5 in the top portions of the lower side plates 4 for receiving the alignment bearing retainer links 7. The split side plates and the links permit the rollers to be easily removed, replaced or cleaned.

Figure 5:
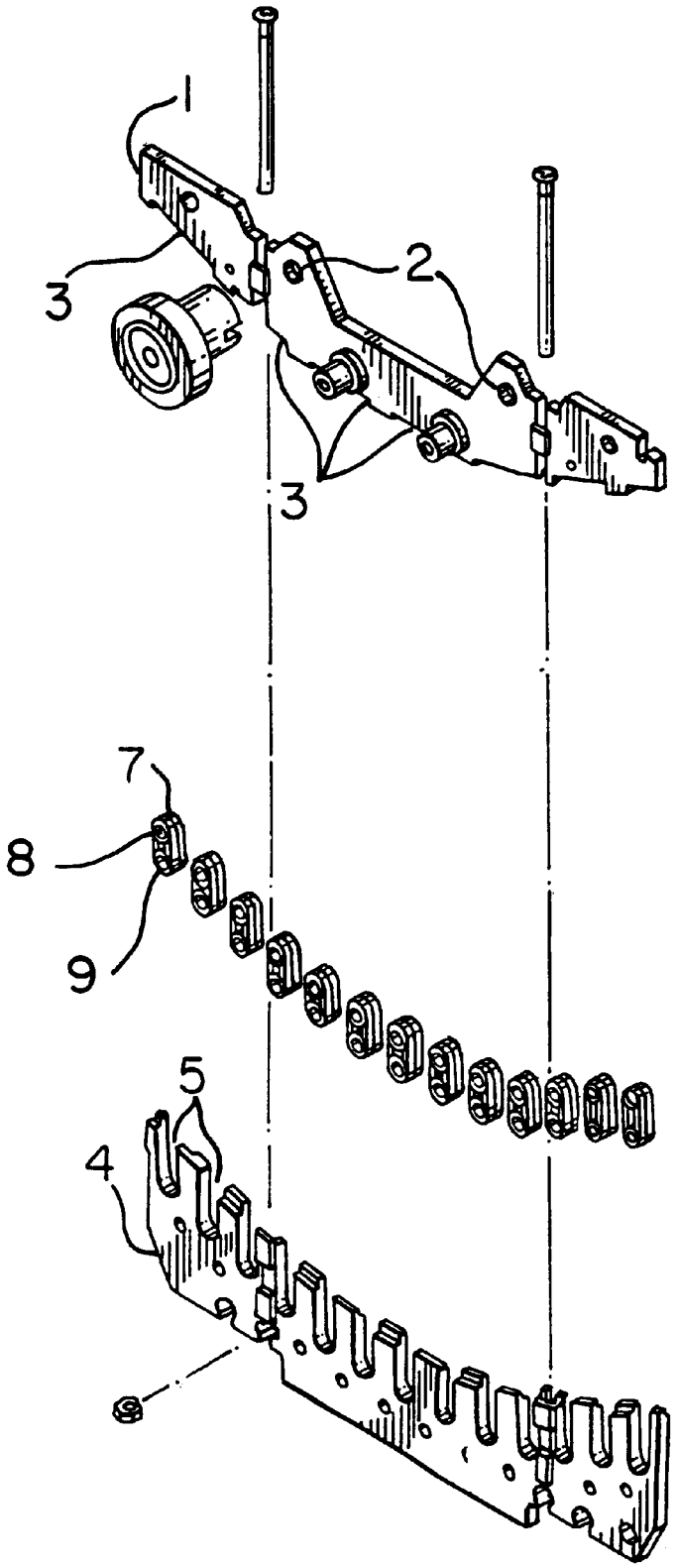
FIG. 5 is an exploded perspective view of upper and lower side plates of the transport system with alignment bearing retainer links.
Figure 7:
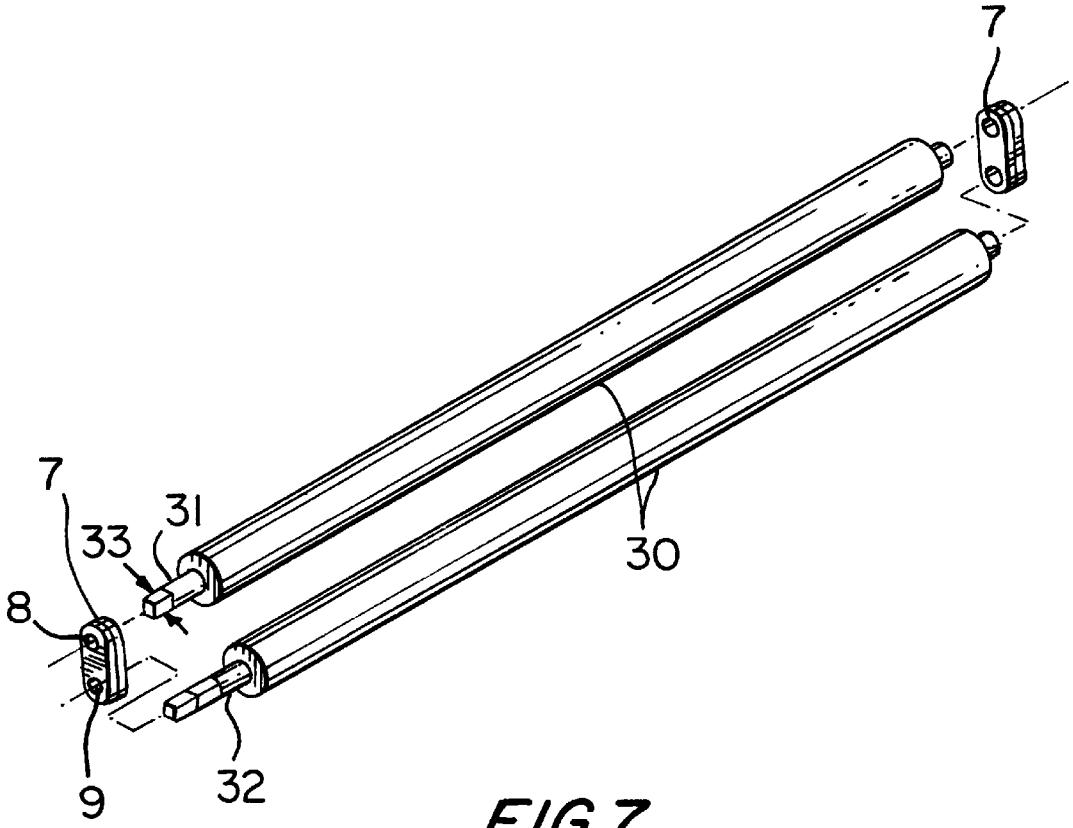
FIG. 7 is a perspective view of an alignment bearing retainer link with a pair of opposed rollers.
Figure 8:
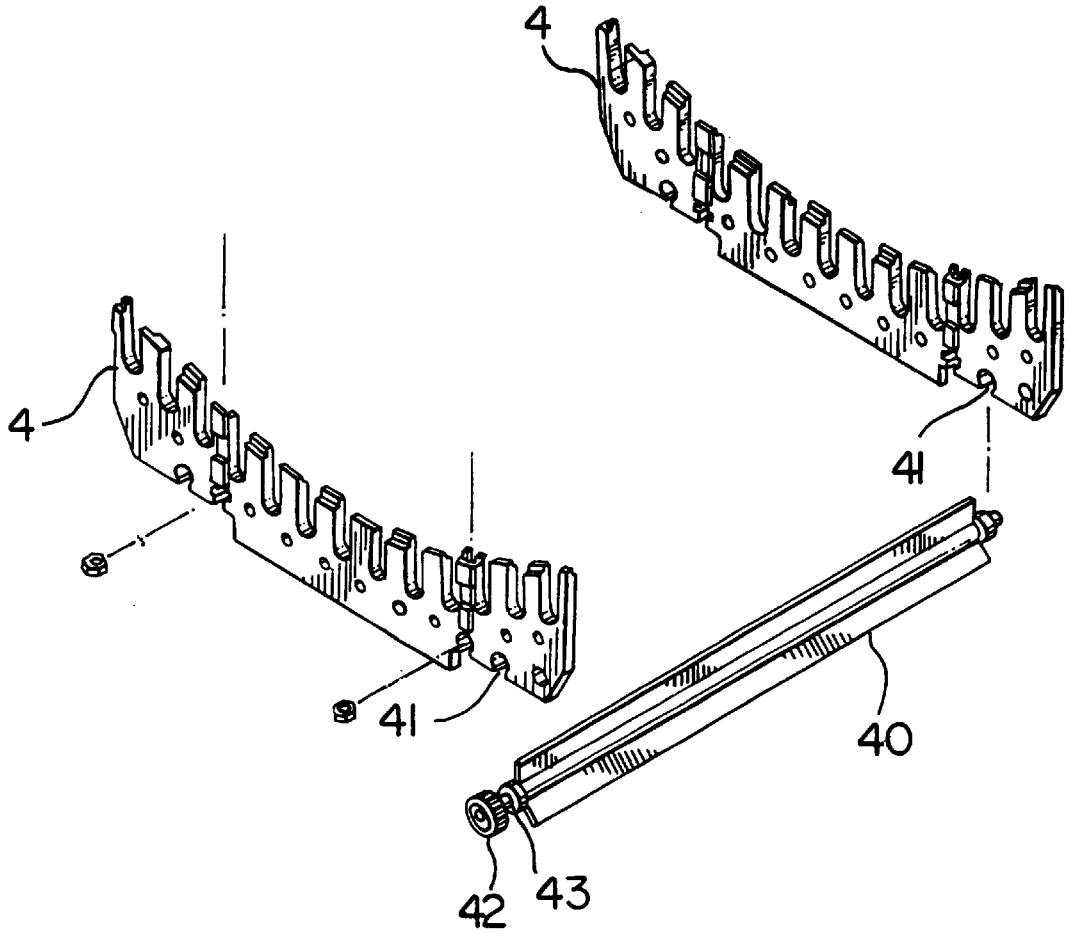
FIG. 8 is a perspective view of lower side plates and a paddle mixer.
Figure 9:
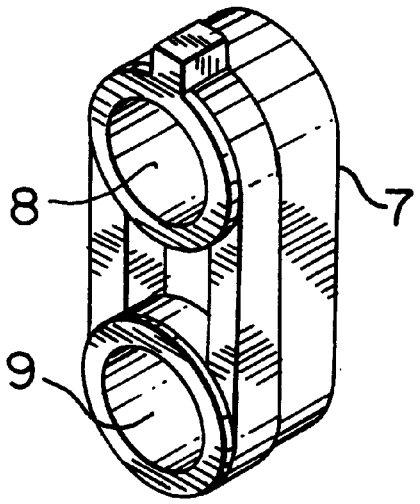
FIG. 9 is a view of an alignment bearing retainer link for the upper and lower round orifices.

Referring to FIGS. 5 and 7, the alignment bearing retainer links 7 each have an upper round orifice 8 having a predetermined diameter for receiving a shaft 31 of an upper roller. The upper round orifice 8 is designed to be larger than an upper roller shaft diameter 33 so that positioning of the upper roller shaft 31 will allow the thickness of a developing film to pass between the opposed rollers 30 of the roller pair. This prevents undesirable artifacts from induced pressure marks while having sufficient tangential contact forces to propel the film along the film path. The alignment bearing retainer links 7 also have a lower round orifice 9 of a pre-determined diameter which receives a shaft 32 of the lower roller.

Figure 6:
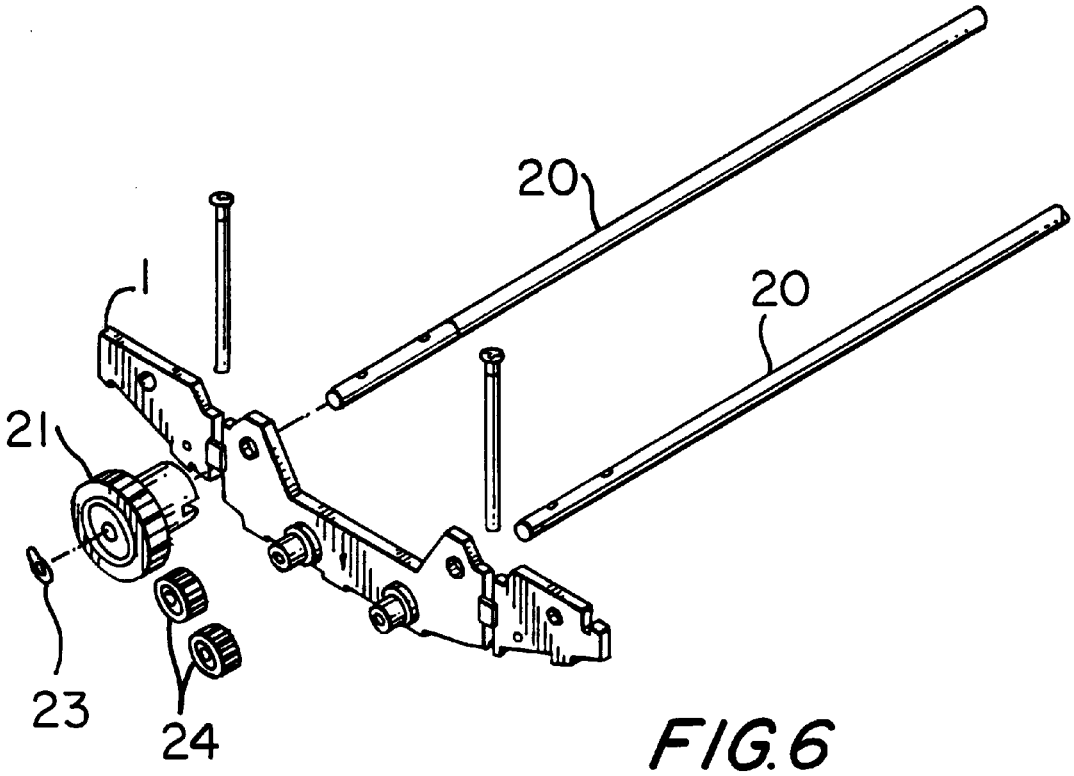
FIG. 6 is an exploded perspective view of an upper plate of the side plate together with power drive shafts and worm gears.
Figure 6A:
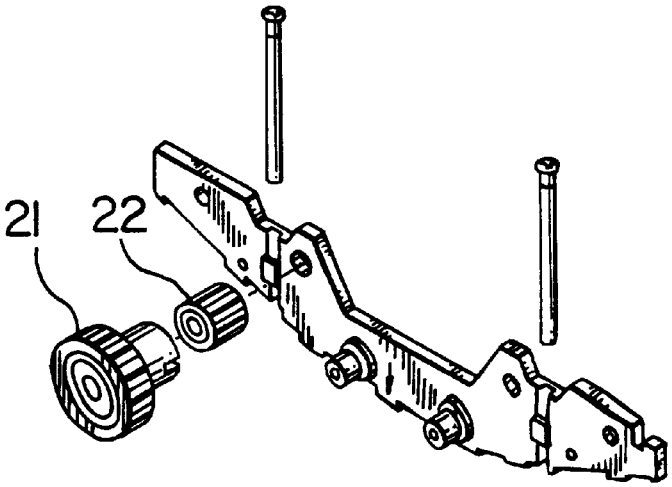
FIG. 6*a* is an exploded perspective view of an upper plate of the side plate with worm gears.

Referring to FIGS. 6–7, there are two independent points of power (torque) input by means of driver worm gears 21 located on the outer surface of one upper side plate 1. Using two drive shafts reduces the need for high torque, so that a low torque output motor may be used. Each worm gear also is axially connected to a multi-tooth driven spur gear 22 and they rotate together around a fixed axis. The driver spur gear 22 engages with and drives a series of alternating idler and roller driven spur gears 24 providing the rotational forces to each opposed roller 30 of a roller pair. The drive shafts 20 have a partial fastener ring 23 externally securing snap-on worm gears 21 to the ends of the drive shafts 20. The fastener rings 23 are readily removable. The worm gears 21 are disengageable or pop-up during film transport malfunction and to allow cleaning. This drive system eliminates the need for a chain drive.

The alignment bearing retainer links 7 provide the desired spacing and mounting for each opposed roller 30 of a roller pair. Each opposed roller pair comprises two roller shafts positioned one on top of the other, as shown in FIG. 4. The alignment bearing retainer links 7 have two different diameter orifices, which appropriately support the two shafts of the opposed rollers in the roller pair. As shown in FIG. 7, in a vertical direction, the lower round orifice 9 supports one end of the lower roller shaft 32 with only sufficient clearance between the lower roller shaft 32 and bearing surface to allow for fluid film lubrication and an optimal, low friction sleeve bearing function. The alignment bearing retainer link 7 includes sufficient shoulder surfaces so that it cannot pass through the mating oval apertures formed by integrating the upper side plate 1 with the lower side plate 4 without disassembly of the system.

In addition, idle spur gears 24 engage with a driven spur gear 42 that is mounted on a support shaft 43 of a solution paddle mixer 40. When the worm gear 21 is engaged with the drive shaft 20, the solution paddle mixer 40 will rotate, thereby agitating a solution in which it is immersed. The solution paddle mixer 40 is secured in a slot 41 located in the lower side plate 4.

Figure 10:
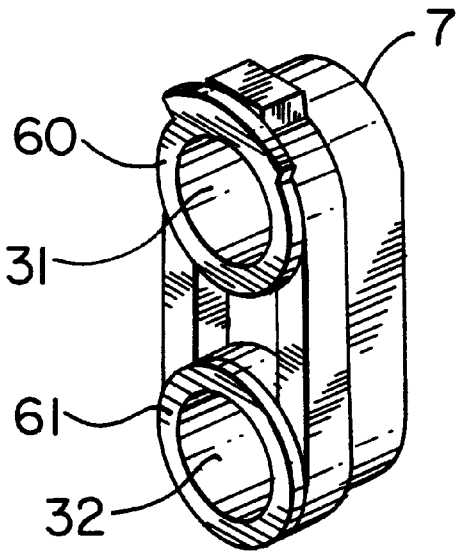
FIG. 10 is a view of an alignment bearing retainer link for the upper and lower roller shafts.

The alignment bearing retainer links 7 are best seen in FIGS. 9–15. The links 7 have upper and lower orifices 8, 9. As shown in FIG. 10, the upper roller shaft 31 fits through the upper round orifice 8 of the alignment bearing retainer link 7. An upper bearing 60 is externally mounted on the upper roller shaft 31 once the upper roller shaft 31 is fitted through the upper round orifice 8 of the alignment bearing retainer link 7. The lower roller shaft 32 fits through the lower round orifice 9 of the link 7. A lower bearing 61 is externally mounted on the lower roller shaft 32 once the lower roller shaft 32 is fitted through the lower round orifice 9 of the alignment bearing retainer link 7.

Figure 11:
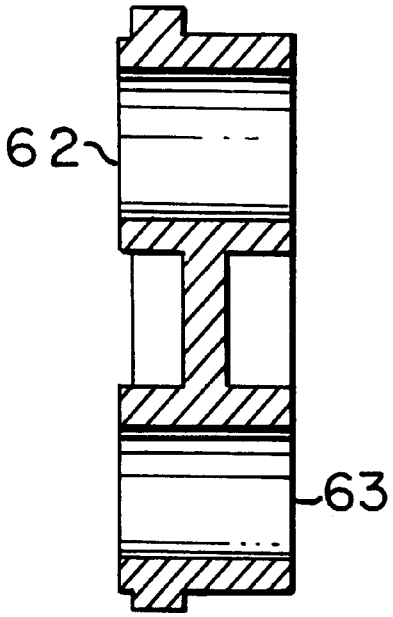
FIG. 11 is a cross-sectional view of the alignment bearing retainer link in FIG. 9.
Figure 12:
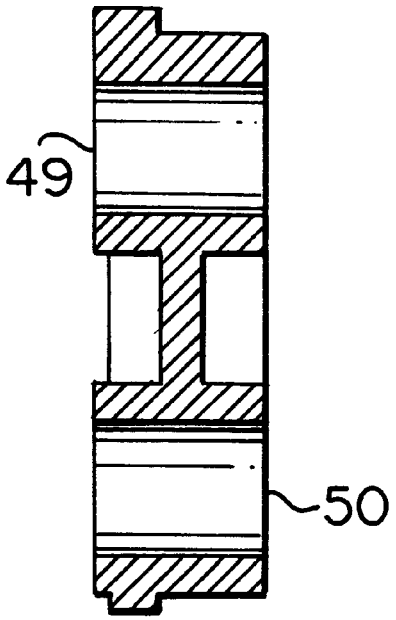
FIG. 12 is a cross-sectional view of the alignment bearing retainer link in FIG. 10.

The upper orifice diameter 62 ranges from 0.216 to 0.220 inches (FIGS. 11–12). The lower orifice diameter 63 ranges from 0.195 to 0.197 inches. The upper roller shaft diameter 49 ranges from 0.195 to 0.197 inches. The lower roller shaft diameter 50 ranges from 0.191 to 0.193 inches. This allows the rollers 30 of each roller pairs to accommodate film of varying thickness. The link pre-aligns and holds the rollers 30 of the roller pair in fixed position relative to each other.

Figure 13:
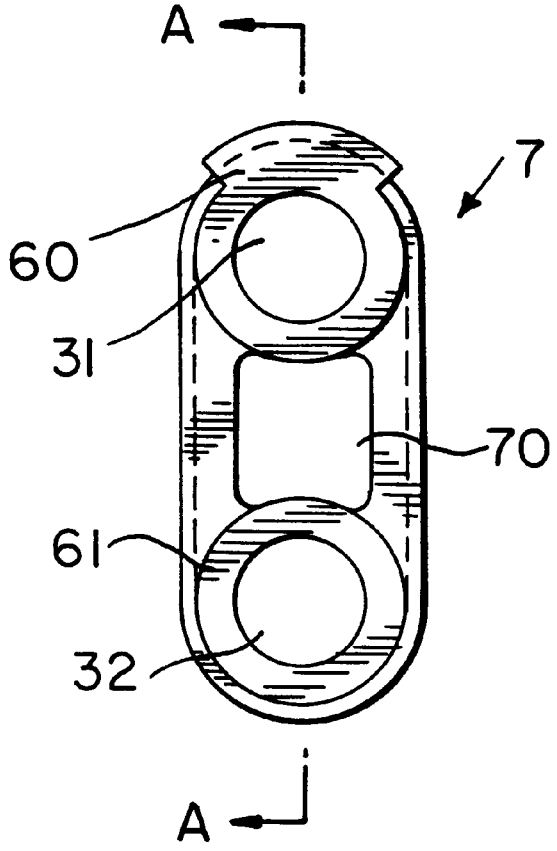
FIG. 13 is a front view of the alignment bearing retainer link.
Figure 13A:
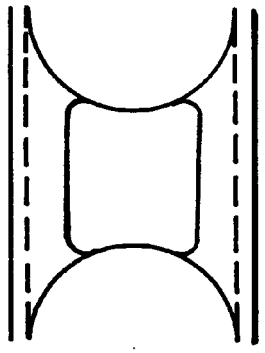
FIG. 13*a* is a detailed view of a part shown in FIG. 13.
Figure 14:
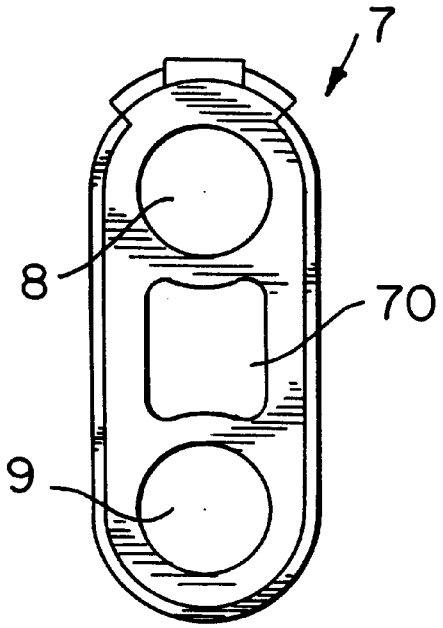
FIG. 14 is a back view of the alignment bearing retainer link.
Figure 15:
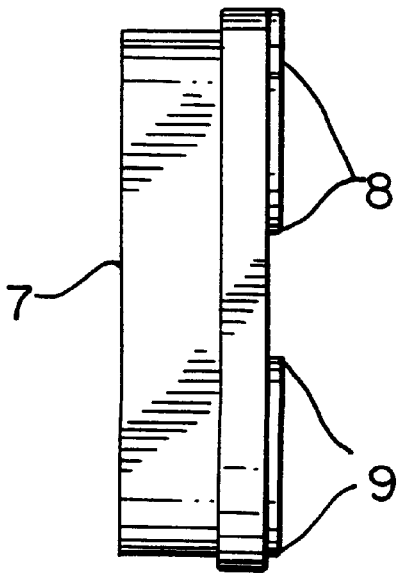
FIG. 15 is a side view of the alignment bearing retainer link.

Upper bearing 60 is a circular ring with a flanged top portion that spans 90 degrees (FIGS. 13–14). Upper bearing 60 is mounted on the upper roller shaft 31. Lower bearing 61 is a circular ring mounted on the lower roller shaft 32. A partial square aperture 70 is located in the center of the alignment bearing retainer link 7. Each of the alignment bearing retainer links 7 is separately removable from the film transport. Thus, the roller pairs may be separately removed for repair and cleaning.

The above description is for the developer transport module of the film processor. It should be appreciated that the fixer transport module is substantially similar. The features of the invention permit ready service and replacement of the transport modules.

Various changes and modifications may be effected by one skilled in the art without departing from the spirit or scope of the invention as defined in the appended claims.

What is claimed is:

1. A film transport device for an automatic film processor, comprising:

at least one opposed roller pair journalled within opposing side plates for transporting film;

each side plate being divisible into at least one upper side plate and at least one lower side plate securing the ends of the rollers of the roller pair in an alignment bearing retainer link; and means for driving the roller pairs to pass film therebetween.

2. A film transport device for an automatic film processor according to claim 1, wherein the upper side plate is separable and removable from the film transport device without disassembly of the lower side plate and the opposed roller pairs from the film transport device.

3. A film transport device for an automatic film processor according to claim 1, wherein at least one of the alignment bearing retainer links is removable from the lower side plate without disturbing the alignment bearing retainer links of the lower side plate.

4. A film transport device for an automatic film processor according to claim 1, wherein the means for driving the roller pairs comprises a motor, at least one driving shaft connected to the motor and an interlocking relational gear assembly.

5. A film transport device for an automatic film processor according to claim 1, wherein the means for driving the roller pairs further comprises at least one snap-on worm gear engaging with at least one multi-tooth driven spur gear and at least one driving shaft.

6. A film transport device for an automatic film processor according to claim 1, wherein the means for driving the roller pairs further comprises a snap-on worm gear disengagable during film transport malfunction.

7. A film transport device for an automatic film processor according to claim 1, wherein the means for driving the roller pairs further comprises a partial ring fastener externally securing a snap-on worm gear to the driving shaft.

8. A film transport device for an automatic film processor, comprising:

at least one opposed roller pair journalled within opposing side plates for transporting film;

each side plate being divisible into at least one upper side plate and at least one lower side plate securing the ends of the rollers of the roller pair in an alignment bearing retainer link;

the alignment bearing retainer link having an upper orifice and a lower orifice to receive, pre-align and hold the rollers of the roller pair in fixed position relative to each other; and means for driving the roller pair to pass film therebetween.

9. A film transport device for an automatic film processor, comprising:

at least one opposed roller pair journalled within opposing side plates for transporting film;

each side plate being divisible into at least one upper side plate and at least one lower side plate securing shafts at the ends of the rollers of the roller pair in an alignment bearing retainer link;

the alignment bearing retainer link including an upper orifice of an internal diameter that is larger than an upper roller shaft external diameter; and means for driving the roller pair to pass film therebetween.

* * * * *